United States Patent [19]

Leibhard et al.

[11] 4,314,655

[45] Feb. 9, 1982

[54] SEALING MEMBER FOR A DEVICE FOR MELTING SOLID ADHESIVE MATERIAL

[75] Inventors: Erich Leibhard; Erwin Schiefer, both of Munich; Peter Stirnweiss, Maisach, all of Fed. Rep. of Germany

[73] Assignee: Hilti Aktiengesellschaft, Schaan, Liechtenstein

[21] Appl. No.: 84,103

[22] Filed: Oct. 12, 1979

[30] Foreign Application Priority Data

Oct. 16, 1978 [DE] Fed. Rep. of Germany ..... 2844932

[51] Int. Cl.[3] ..... B67D 5/62

[52] U.S. Cl. ..... 222/146 HE; 285/50; 219/230

[58] Field of Search ..... 222/146 H, 146 HE; 285/47, 48, 50; 219/230, 241

[56] References Cited

U.S. PATENT DOCUMENTS

| | | | |
|---|---|---|---|
| Re. 27,828 | 12/1973 | Salonen | 222/146 HE |
| 373,452 | 11/1887 | Gennert | 285/48 |
| 382,272 | 5/1888 | Robb | 285/50 |
| 426,121 | 4/1890 | Gennert | 285/50 |
| 1,449,517 | 3/1923 | Lame | 219/421 |
| 3,003,049 | 10/1961 | Thomas | 219/230 |
| 3,278,202 | 10/1966 | Smith | 285/50 |
| 3,298,572 | 1/1967 | Newton | 222/146 HE |
| 3,430,816 | 3/1969 | Nadherny et al. | 222/146 HE |
| 3,743,142 | 7/1973 | Elliot et al. | 222/146 HE |
| 4,150,770 | 4/1979 | Wieland et al. | 219/230 |

FOREIGN PATENT DOCUMENTS

| | | | |
|---|---|---|---|
| 1196161 | 6/1970 | United Kingdom | 285/47 |

*Primary Examiner*—H. Grant Skaggs

*Attorney, Agent, or Firm*—Toren, McGeady and Stanger

[57] ABSTRACT

In a device for melting a body of solid thermoplastic adhesive material, a melting chamber is located within the housing and the adhesive material is fed into the melting chamber by a feed apparatus. A rubber-like elastic gasket is located at the inlet end of the chamber providing a seal around the adhesive material entering the chamber for preventing leakage of molten material back into the housing. An insulator ring formed of a thermostable, poor heat conducting material is located between the melting chamber inlet and the gasket to limit the passage of heat to the gasket. Preferably, the insulator ring is formed of TEFLON.

5 Claims, 1 Drawing Figure

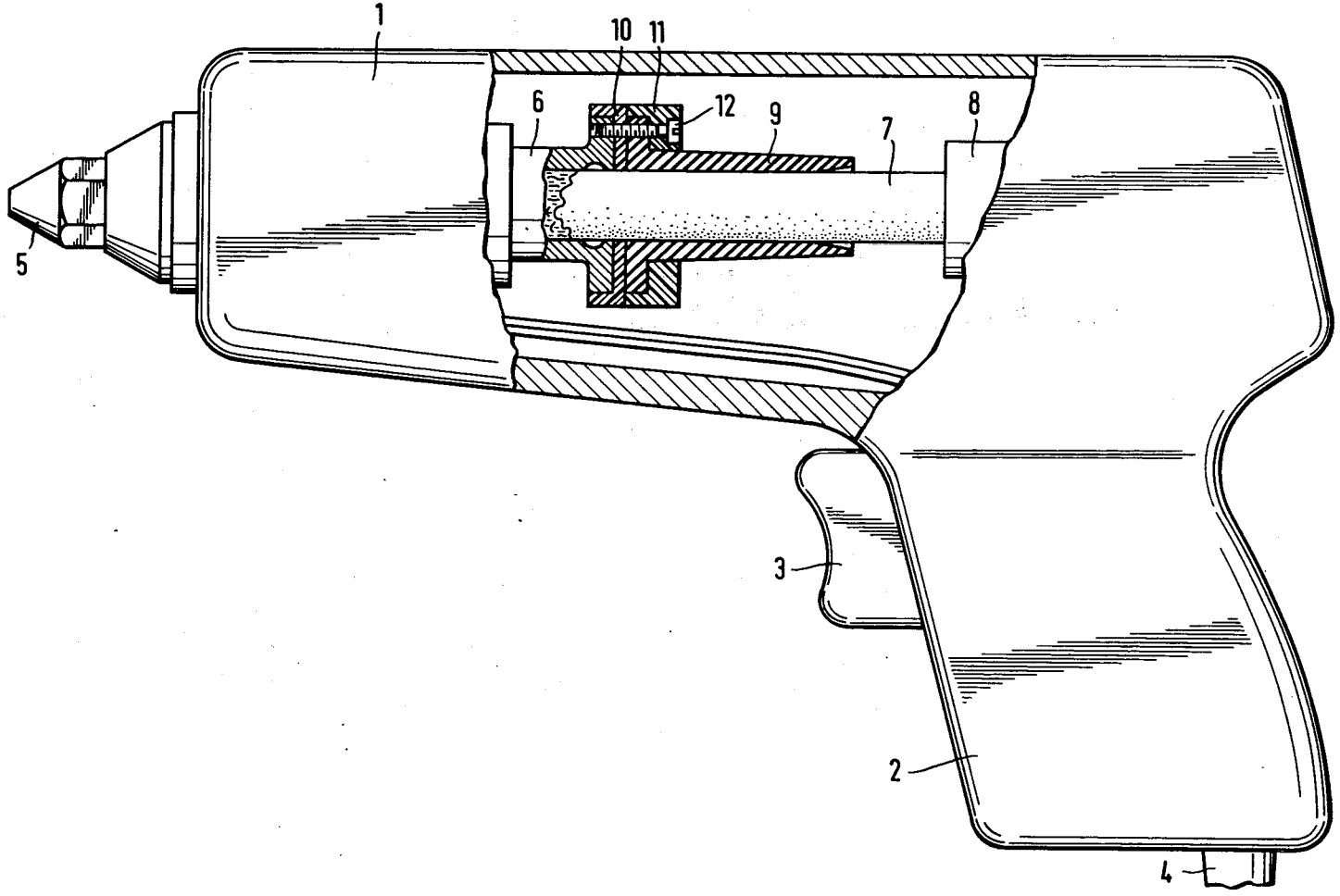
1
2
3
4
5
6
7
8
9
10
11
12

SEALING MEMBER FOR A DEVICE FOR MELTING SOLID ADHESIVE MATERIAL

SUMMARY OF THE INVENTION

The present invention relates to a device for melting a solid body of a thermoplastic adhesive material, and providing for a dosed discharge of the molten material. The device includes a melting chamber located within a housing with a gasket formed of a thermostable, rubber-like elastic material positioned at the inlet side of the melting chamber. The internal surface of the gasket conforms to the surface of the body of adhesive material so that a seal is provided at the inlet side of the melting chamber.

In devices of this general type, one of the key problems encountered is providing a seal at the inlet side of the melting chamber. If the seal is defective and the molten material escapes from the inlet of the melting chamber, then the interior of the device becomes blocked with the leaking material as it resolidifies. When such leakage occurs, extended operating stoppages develop or the device may be completely destroyed by overheating due to a thermostat failure. The problem stems from the fact that the solid body of adhesive material is required to seal the inlet into the melting chamber. During production, not only the cross sectional shape but also the cross sectional dimensions of the solid body of adhesive material may vary so that a uniform cross sectional size and shape of the body is not achieved. Accordingly, a gasket formed of a thermostable, rubber-like elastic material is positioned at the inlet into the melting chamber so that, in combination with the solid body, it provides a seal. Due to the elasticity of the material forming the interior surfaces of the gasket, the gasket can adapt within certain limits to the shape and dimensions of the body of adhesive material.

To meet its functional requirements, the gasket must be selected primarily to afford sufficient elasticity, and, furthermore, the material of the gasket must be thermostable. The part of the gasket which adjoins the inlet to the melting chamber is exposed, however, to extremely high temperatures which known rubber-like elastic materials cannot withstand. As a result, during extended operation of the device, the material forming the gasket in regions adjacent to the melting chamber becomes locally overheated and results in burned portions and embrittlement. Subsequently, at such locations the gasket material deteriorates and the gasket must be replaced.

The primary object of the present invention is to provide a device for melting a solid body of an adhesive material, such as a thermoplastic material and for affording dosed discharge of the molten material including an assembly which provides an effective seal for the inlet into the melting chamber with the assembly having a sufficiently extended useful life under the expected operating temperature conditions.

Based on the present invention, the assembly includes a gasket and an insulator ring with the insulator ring separating the gasket from the melting chamber. The insulator ring is formed of a thermostable, poor heat conducting material and prevents direct contact between the melting chamber and the gasket.

Accordingly, the sealing requirements for the device are provided by the assembly of these two separate components. For each function of the assembly, the most suitable material can be found. Furthermore, if there is a failure of the sealing assembly usually only one of the components need be replaced. Therefore, maintenance and replacement costs can be reduced.

In the past most gaskets have been attached directly to the melting chamber. Such an arrangement has certain technical advantages in that the melting chamber and gasket can be formed as a unit and then built into the housing. For attaching such a unit a screw collar ring has been found to be suitable with the connection to the melting chamber being effected by screws or a screw thread. In such screw connections, the threads can form a thermal bridge so that the gasket in the range of its attachment to the melting chamber is placed under elevated temperatures. To prevent the passage of excessive temperatures to the gasket, a screw collar ring formed of a thermostable, poor heat conducting material is being used for securing the gasket to the melting chamber. Such a screw collar ring prevents any metallic contact between the melting chamber and the gasket.

In accordance with the present invention, materials of low heat conductivity and high thermostability, such as asbestos, ceramics and the like, can be used for the insulator ring. More specifically, however, it has been found in tests where a screw collar ring is used for attaching the insulator ring to the gasket, that an insulator ring formed of polytetrafluorethylene (TEFLON) is particularly suitable. Apart from its good thermostability, polytetrafluorethylene or PTFE has the further advantage of a low friction coefficient and the characteristic that the adhesive material does not stick to it. Accordingly, because of the ability of the body of adhesive material to slide relative to the TEFLON ring, the power required for feeding the body of adhesive material into the melting chamber is reduced.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated aand described preferred embodiments of the invention.

BRIEF DESCRIPTION OF THE DRAWING

The drawing is a side view, partly in section, of a device for melting a solid body of an adhesive material and for effecting the dosed discharge of the molten material, in accordance with the present invention.

DETAIL DESCRIPTION OF THE INVENTION

In the drawing, the device embodying the present invention includes a gun-shaped housing 1 having a handle 2 extending downwardly from one end of the housing. A push button or trigger 3 is located in the handle. An electrical power line 4 is connected to the lower end of the handle. As viewed in the drawing, the left-hand end of the housing forms its outlet end and a nozzle 5 provides for the discharge and/or application of the molten material. Within the housing 1 adjacent to the nozzle 5 is a melting chamber 6 spaced inwardly from the housing. A solid body 7 of adhesive material is transported in a continuous manner through the housing into the melting chamber by means of a known feed apparatus 8. The feed apparatus 8 is actuated by the trigger 3 on the handle 2. At the rear or inlet end of the melting chamber 6 facing toward the feed apparatus 8 is an elongated tubular shaped gasket 9. An insulator ring 10 is positioned between the melting chamber 6 and the gasket 9, that is, the insulator ring spaces the inlet end of the chamber from the gasket. The insulator ring is formed of a thermostable, poor heat conducting material for limiting the passage of heat from the melting chamber to the gasket. To complete the assembly of the gasket 9 to the melting chamber 6, a screw collar ring 11 latterally encircles a flanged end of the gasket in contact with the insulator ring 10. A screw 12 extends through the collar ring 11, the flanged end of the gasket 9 and the insulator ring 10 into the inlet end of the melting chamber. The screw collar ring 11 is formed of a thermostable, poor heat conducting material, such as polytetrafluorethylene (TEFLON), as is the insulator ring 10. Gasket 9 is formed of a rubber-like elastic material of lower thermostability than the material forming the insulator ring and screw collar ring. Silicon rubber can be used as the material forming the gasket 9.

While specific embodiments of the invention have been shown and described in detail to illustrate the application of the inventive principles, it will be understood that the invention may be embodied otherwise without departing from such principles.

What is claimed is:

1. Device for melting a body of a solid thermoplastic adhesive material, and for providing for the dosed discharge of the molten material comprising a housing, a melting chamber located with and spaced inwardly from said housing, said melting chamber having an inlet end through which the adhesive material is supplied into said melting chamber, an annular gasket located at the inlet end of said melting chamber for effecting a seal around the adhesive material as it is fed into the melting chamber so that the molten material cannot leak out of the inlet end of said melting chamber, the interior of said gasket being shaped and sized to provide sealed contact with the surface of the solid body of adhesive material, wherein the improvement comprises that said annular gasket is an axially elongated, tubular member aligned with and extending axially away from the inlet end of said melting chamber, said tubular member forming an elongated bore communicating directly into said melting chamber so that the body of thermoplastic adhesive material extends continuously from said gasket into said melting chamber an insulator ring positioned between and completely separating the inlet end of said melting chamber and said gasket, the opening in said ring forming a continuation of the bore in said gasket into said melting chamber, said insulator ring is formed of a thermostable poor heat conducting material for limiting the passage of heat from said melting chamber to said gasket, means in contact with said insulating ring for fixing said gasket to said inlet end of said melting chamber and said means is formed of a material for preventing a thermal bridge between said melting chamber and said annular gasket and including a screw member extending through said means in contact with insulating ring, said gasket, said insulator ring and said melting chamber for securing said gasket to said melting chamber.

2. Device, as set forth in claim 1, said means for fixing said gasket comprising a screw collar ring laterally encircling the end of said gasket contacting said insulator ring for securing said gasket to said insulator ring and said melting chamber, and said screw collar ring being formed of a thermostable, poor heat conducting material.

3. Device, as set forth in claim 2, wherein said insulator ring and said screw collar ring are formed of polytetrafluorethylene.

4. Device, as set forth in claim 1, wherein said gasket having a first end adjacent to the inlet end of said melting chamber and a second end forming an inlet to receive the solid body of adhesive material for passage through said gasket into said melting chamber, and the inside surface of said gasket at the second end thereof being enlarged for assisting in the passage of the solid body of adhesive material into said gasket.

5. Device for melting a body of a solid thermoplastic adhesive material, and for providing for the dosed discharge of the molten material comprising a housing, a melting chamber located within said housing, said melting chamber having an inlet end through which the adhesive material is supplied into said melting chamber, an annular gasket located at the inlet end of said melting chamber for effecting a seal around the adhesive material as it is fed into the melting chamber so that the molten material cannot leak out of the inlet end of said melting chamber, the interior of said gasket being shaped and sized to provide sealed contact with the surface of the solid body of adhesive material, wherein the improvement comprises an insulator ring positioned between and completely separating the inlet end of said melting chamber and said gasket, said insulator ring is formed of a thermostable poor heat conducting material for limiting the passage of heat from said melting chamber to said gasket, means in contact with said insulator ring for fixing said gasket to said melting chamber and said means is formed of a material for preventing a thermal bridge between said melting chamber and said annular gasket, said means for fixing said gasket comprising a screw collar ring laterally encircling the end of said gasket contacting said insulator ring for securing said gasket to said insulator ring and said melting chamber, said screw collar ring is formed of a thermostable, poor heat conducting material, said insulator ring and said screw collar ring are formed of polytetrafluorithylene (TEFLON), said insulator ring is cap-shaped having an annular disk-like part extending radially outwardly from the inlet end of said melting chamber and an annular flange-like part encircling the radially outer periphery of said disk-like part and extending therefrom in the direction toward said melting chamber with the inner surface of said flange-like part in contact with the outer surface of said melting chamber so that said insulator ring fits over the inlet end of said melting chamber, said gasket having an outwardly flanged end in contact with said insulator ring, and said screw collar ring being cap-shaped having an annular disk-like part extending radially outwardly from the outer surface of said gasket and an annular flange-like part encircling the radially outer periphery of said flange-like part and extending therefrom toward said melting chamber with the inner surface of said flange-like part encircling and contacting said gasket and the surface of said flange-like part closest to said melting chamber contacting said insulator ring and fitted over and laterally enclosing the flanged end of said gasket, and said screw collar ring including screw means for securing said screw collar ring, gasket and insulator ring to said melting chamber.

* * * * *